United States Patent [19]

Aliev et al.

[11] 3,950,245

[45] Apr. 13, 1976

[54] METHOD OF BREAKING DOWN OIL EMULSIONS

[76] Inventors: Vagab Safarovich Aliev, ulitsa Nizami, 66, kv. 40; Natalia Borisovna Altman, ulitsa Patrisa Lumumby, 31, kv. 45, both of Baku; Pavel Petrovich Galonsky, Naberezhnaya Shevchenko, 1/2, kv. 80, Moscow; Alexandr Davidovich Guterman, ulitsa Patrisa Lumumby, 31, kv. 45, Baku; Lia Vasilievna Malina, ulitsa Krzhizhanovskogo, 2, kv. 51, Elektrogorsk Moskovskoi oblasti; Rafkhat Shagimardanovich Mingareev, ulitsa Bolshaya Bronnaya, 29, kv. 75, Moscow; Alekper Bagirovich Suleimanov, ulitsa Sameda Vurguna, 85, kv. 75, Baku, all of U.S.S.R.; Mansur Ilal ogly Akhmedov, deceased, late of Baku, U.S.S.R.; by Elmira Mamed Emin kyzy Ramazanova, administrator, prospekt Lenina, 16/21, kv. 10, Baku, U.S.S.R.

[22] Filed: June 28, 1974

[21] Appl. No.: 484,632

[52] U.S. Cl. ..... 208/187

[51] Int. Cl.[2] ..... C10G 33/00

[58] Field of Search ..... 208/187, 188, 185, 184

[56] References Cited

UNITED STATES PATENTS

| | | | |
|---|---|---|---|
| 1,927,823 | 9/1933 | Davis et al. | 208/187 |
| 2,930,749 | 3/1960 | Davis | 208/187 |

FOREIGN PATENTS OR APPLICATIONS

| | | | |
|---|---|---|---|
| 1,003,217 | 9/1965 | United Kingdom | 208/187 |

*Primary Examiner*—Delbert E. Gantz
*Assistant Examiner*—G. J. Crasanakis
*Attorney, Agent, or Firm*—Holman & Stern

[57] ABSTRACT

A method of breaking down oil emulsions comprising, in accordance with the invention, heating the oil emulsion to be broken down to a temperature of from 40° to 70°C, preferably from 60° to 65°C, and bubbling air at the rate of from 0.1 to 10 $nm^3$ per 1 $m^3$ of the emulsion (preferably from 1 to 4 $nm^3$ per 1 $m^3$ of the emulsion) through said heated oil emulsion until total breakdown thereof occurs as a result of oxidation of the natural oil emulsifiers contained therein.

3 Claims, No Drawings

METHOD OF BREAKING DOWN OIL EMULSIONS

The present invention relates to the oil refining industry and more particularly to the field of oil preparation for refining; more specifically still, it relates to methods of breaking down oil emulsions.

Thermochemical methods of breaking down stable oil emulsions are known in the art which comprise reacting the oil emulsions to be broken down with demulsifiers (chemical agents) of both ionogenic and non-ionogenic types at specified elevated temperatures.

The prior methods of thermochemical breaking of oil emulsions are essentially carried out as follows:

Depending on the stability and properties of the particular wellhead crude emulsions or petroleum product emulsions, the proper set of operating conditions (temperature, separation time, demulsifier consumption, etc.) is found by trial and error.

The oil emulsion with an initial water content of from 2 to 3 to 50 to 60 volume percent, together with the demulsifier, is pumped through a heat exchanger or a furnace, wherein the mixture is heated to a predetermined temperature, generally to 60° or 70°C, wherefrom the heated mixture is delivered into a tank wherein, during a specified settling time, the emulsion is separated into oil and water. The dwelling time of the heated oil emulsion in the separating tank varies from several hours to a day and more, depending on the nature and stability of the emulsion. The settled water is drained through an outlet in the bottom of the tank.

The demulsifier is mixed with the oil emulsion before the latter is fed into the furnace or heat exchanger, thereby providing for a higher degree of demulsifier-oil contact. In certain cases, dealing with particularly viscous grades of oil, optimal contact conditions are achieved by feeding the demulsifier into the hot oil followed by agitation thereof in special mixers.

In certain cases, a special separating tank with heated walls is employed for the settling of the emulsion and separation of water; this tank is provided with an overflow pipe through which the dehydrated oil or oil products continuously flow into storage vessels while the settled water is regularly drained.

The foregoing methods for breaking down oil emulsions (demulsification) usually employ chemical demulsifiers which are synthesized from extremely valuable monomers that, if eliminated, from this application, would be most useful in various branches of petrochemistry.

Said chemicals require premium raw materials and exceedingly sophisticated processes to be produced. The method of breaking down oil emulsions by use of said synthetic reagents is very sophisticated, labour consuming, and costly.

Furthermore, the water-soluble chemicals employed in the oil refining industry for breaking oil emulsions pollute the open water bodies into which they are dumped together with the demulsification water, while the oil-soluble reagents are furthermore dangerously toxic and thus pose a hazard in synthesis, application and disposal.

Another method is known to the skilled in the art of breaking down oil emulsions, wherein a thermochemical demulsification process utilizing chemical demulsifiers whose contact with the oil emulsion is ensured by feeding any gas, including hydrocarbon gas or air, into the oil emulsion. The use of air according to said known method provides only for optimal contact conditions, and nothing else, so that this latter method, too, features the above-mentioned disadvantages inherent in the thermochemical breakdown of oil emulsions.

It is an object of the present invention, therefore, to provide an effective and simple process for breaking down oil emulsions.

The foregoing object is attained by the provision of a method of breaking down oil emulsions, which comprises heating the oil emulsion to be broken down to a temperature of from 40° to 70°C, bubbling air at the rate of from 0.1 to 10 $nm^3$ (normal cubic meters) per 1 $m^3$ of the oil emulsion through said heated petroleum emulsion until said emulsion is totally broken down due to the oxidation of the natural oil emulsifiers contained therein, keeping the emulsion in a separating tank until oil and water are separated, and finally separating oil from water.

The inventive concept of the proposed method of breaking down oil emulsions resides in that the latter are subjected to air treatment under the above-described conditions which provide for selective oxidation of the natural emulsifiers contained in oil emulsions, inter alia, the tars and asphaltenes.

It is common knowledge that the natural emulsifiers, viz. tarry-asphaltic substances, contained in oil emulsions lend them stability.

The level of natural emulsifiers proper in the tarry-asphaltic substances account for not more than 0.01 to 1 volume percent, depending on the nature and origin of emulsion oils.

Said natural emulsifiers, mostly tarry-asphaltic substances (although naphthenic acids, soaps, various salts, mechanical admixtures, and the like, are likewise known to exhibit emulsifying properties), contained in the high-molecular weight ingredients of oil, being surfactants, are disposed at the oil-water interface and form a boundary layer which determines the degree of stability of a given oil emulsion.

In order to break down oil emulsions, the present invention provides a novel method which makes it possible to convert natural surface-active emulsifiers into emulsion-inert substances, and to simultaneously ensure desorption of the natural emulsifiers from the boundary layer serving as a phase interface, thereby providing for the liberation and coalescence of water drops, and subsequently allowing them to settle and be separated from the oil. As a result, the oxidized natural emulsifiers pass into the water phase in the form of a sediment.

In order to attain the above-described objectives, air is employed as an agent providing for the breakdown of oil emulsions through oxidation of the natural oil emulsifiers. Oxygen may likewise be employed for oxidatively breaking oil emulsions; however, in the latter case, the cost considerations may be prohibitive. The method of the present invention applies both to natural oil emulsions and to the emulsions of oil products, e.g. emulsion kerosene, gas oil, and lubricants.

The proposed method can be effectively employed for breaking down oil emulsions having any water content (from 2 to 80 vol.%) and salt content (from 50 to 200,000 mg/l), having extremely widely varying in hydrocarbon compositions, including naphthenic-aromatic high-tar oils, high-tar paraffin oils, high-paraffin tarry oils, paraffin high-tar oils, naphthenic-aromatic tarry oils, high-paraffin low-tar oils, etc.

Depending on the hydrocarbon composition of a particular oil emulsion, the amounts of tars and asphaltenes it contains, and its water content, breakdown temperatures of from 40° to 70°C and consumption rates of from 0.1 to 10 $nm^3$ per 1 $m^3$ of the oil emulsion are contemplated.

Using the above temperatures, and air consumption rates, it is possible to break down oil emulsions of any origin and stability.

The preferred temperature range to be employed for breaking down oil emulsions is from 60° to 65°C.

Most known oil emulsions are completely broken down at said temperatures.

When realizing the proposed method of breaking down oil emulsions, it is preferred that air should be bubbled through the emulsion at the rate of from 1 to 4 $nm^3$ per 1 $m^3$ of the oil emulsion.

The above temperatures and air consumption rates provide for mild conditions of oxidation of natural oil emulsifiers thus, leaving hydrocarbons unoxidized.

As can be seen from the foregoing, the proposed method offers the following advantages over the prior art techniques.

The proposed method permits dispensing with water-soluble chemical demulsifying agents polluting the open waters whereinto they are dumped together with the demulsification water, as well as with the oil-soluble demulsifying agents thus presenting a toxic hazard in synthesis and in application. The method of this invention is easy to operate and can be readily put into practice with the use of known operating demulsification units, requiring but insignificant outlays for reconstruction which consists in installing air-supply equipment. The rates of power consumption in the practice of the proposed method do not exceed those involved in the prior art techniques.

The proposed method offers an additional advantage of versatility, for it may be applied to oil emulsions of virtually any origin and nature.

The method of this invention is embodied as follows:

An oil emulsion of any water content (from 4 to 80 vol.%) and salt content (from 50 to 200,000 mg/l), having any one of an extremely wide range of hydrocarbon compositions, including naphthenic-aromatic, high-tar, high-tar paraffin, high-paraffin tarry, paraffin high-tar, naphthenic-aromatic tarry, high-paraffin low-tar, and other grades of oil, are pumped into a furance or a heat exchanger for heating. There they are heated to a temperature of from 40° to 70°C, the oil emulsion is fed into a tank whereinto air is supplied in predetermined amounts (from 0.1 to 10.0 $nm^3$ per 1 $m^3$ of the oil emulsion) through distributing devices, e.g. a bubbler unit located on the tank bottom. Such a pattern for the air supply provides for a uniform distribution of air through the entire volume of the tank.

The bubbling operation continues for 60 minutes. Said operating conditions absolutely rule out any possibility of oil hydrocarbon oxidation. The results of demulsification are best with an oil emulsion heated to a temperature of from 60° to 65°C and with air being bubbled there-through at the rate of 1 to 4 $nm^3$ per 1 $m^3$ of the oil. As soon as the bubbling procedure is over, the air supply is shut off, with the oil emulsion being left in the same tank to settle. Settling lasts for from 30 minutes to 4 hours. During that time oil and water are completely separated, and water is subsequently drained through the tank bottom.

The demulsification water contains no organic compounds so that, while fully complying with the operating hygienic standards, it may be either recycled, or safety dumped into open water bodies.

The separated oil, either anhydrous or containing water traces not exceeding 0.3 percent, is removed through the top of the tank. The salt content of the anhydrous oil is usually within from 3 to 5 mg/l.

Still another advantage of the method of this invention consists in that, should the demulsification procedure fail to provide for the required minimum of residual salts (within 10 mg/l), the resultant anhydrous oil can be washed with hot water.

This hot water washing is effected as follows:

Hot water is taken at the rate of 10 vol.% of the oil. The desired amount of hot water is delivered to the inlet of the pump transferring the oil from the separating tank to storage vessels. As a result of the contact of hot water with oil, the excess salts are washed out to be solubilized in water which is separated from oil by settling and drained through the bottom of the tank. Hot water washing of the oil does not result in the emergence of a new emulsion, for during the bubbling procedure all natural emulsifying agents were oxidized and passed to the demulsification water.

Practice of the novel method of this invention may be further understood by reference to the following examples of breaking down various stable oil emulsions.

EXAMPLE 1

The oil emulsion is a naphthenic-aromatic tarry oil containing 5 vol.% tars.

The initial water content is 40 vol.%; the salt content is 11,500 mg/l.

Said oil emulsion is heated to 40°C, and then air is bubbled therethrough at the rate of 0.1 $nm^3$ per 1 $m^3$ of the oil emulsion. The time of contact of the oil emulsion with air is 10 minutes; the time of oil separation from water is 2 hours.

The result of demulsification is anhydrous oil having a residual salt content of 5 mg/l.

EXAMPLE 2

The oil emulsion is a high-tar oil having a tar content of 18 vol.%.

The initial water content is 22 vol.%; the salt content is 1,050 mg/l.

Said oil emulsion is heated to 70°C. Air is supplied at the rate of 10 $nm^3$ per 1 $m^3$ of the oil emulsion. The time of oil-air contact is 60 minutes; the time of oil separation from water is 4 hours.

Demulsification yields anhydrous oil with a residual water content of 0.1% and a residual salt content of 7 mg/l.

EXAMPLE 3

The oil emulsion is a high-tar paraffin oil containing 15 vol.% of tars.

The initial water content is 48 vol.%; the salt content is 105,000 mg/l.

The said oil emulsion is heated to 65°C, and then air is bubbled therethrough at the rate of 4 $nm^3$ per 1 $m^3$ of the oil emulsion. The time of the oil-air contact is 15 minutes; the time of oil separation from water is 1 hour.

The demulsification yields anhydrous oil with a residual water content of 0.15%, and a residual salt content of 8 mg/l.

EXAMPLE 4

The oil emulsion is a high-paraffin tarry oil containing 3 vol.% of tars.

The initial water content is 4 vol.%; the salt content is 50 mg/l.

The oil emulsion is heated to 60°C, and then air is bubbled therethrough at the rate of 1 $nm^3$ per 1 $m^3$ of oil emulsion. The time of oil-air contact is 1 minute; the time for oil separation from water is 30 minutes.

The demulsification yields anhydrous oil containing 3 mg/l of salts.

EXAMPLE 5

The oil emulsion is a paraffin high-tar oil containing 18 vol.% of tars.

The initial water content is 47 vol.%; the salt content is 13,800 mg/l.

Said oil emulsion is heated to 65°C, and then air is bubbled therethrough at the rate of 4 $nm^3$ per 1 $m^3$ of the oil emulsion. The time of oil-air contact is 5 minutes; the time for oil separation from water is 1 hour.

The demulsification yields anhydrous oil having a residual water content of 0.2% and a residual salt content of 6 mg/l.

EXAMPLE 6

The oil emulsion is a naphthenic-aromatic tarry oil containing 7 vol.% of tars.

The initial water content is 24 vol.%; the salt content is 2,970 mg/l.

Said oil emulsion is heated to 60°C, and then air is bubbled therethrough at the rate of 1 $nm^3$ per 1 $m^3$ of the oil emulsion. The time of oil-air contact is 25 minutes; the time for oil separation from water is 1 hour.

The demulsification yields anhydrous oil having a residual water content of 0.1% and a residual salt content of 3 mg/l.

EXAMPLE 7

The oil emulsion is a high-paraffin low-tar oil containing 1 vol.% of tars.

The initial water content is 25 vol.%; the salt content is 1,870 mg/l.

Said oil emulsion is heated to 60°C, and then air is bubbled therethrough at the rate of 1 $nm^3$ per 1 $m^3$ of the oil emulsion. The time of oil-air contact is 3 minutes; the time for oil separation from water is 30 minutes.

The demulsification yields anhydrous oil having a residual salt content of 3 mg/l.

EXAMPLE 8

The oil emulsion is a naphthenic-aromatic high-tar oil containing 15 vol.% of tars.

The initial water content is 80 vol.%; the salt content is 200,000 mg/l.

Said oil emulsion is heated to 65°C, and then air is bubbled therethrough at the rate of 4 $nm^3$ per 1 $m^3$ of the oil emulsion. The time of oil-air contact is 60 minutes; the time for oil separation from water is 4 hours.

The demulsification yields anhydrous oil having a residual water content of 0.1% and a residual salt content of 7 mg/l.

EXAMPLE 9

The emulsion is kerosene obtained by the direct distillation of high-molecular weight oils.

The tar content in the kerosene is 0.3 vol.%; the water content of the emulsion is 15 vol.%.

Said emulsion is heated to a temperature of 60°C, and then air is bubbled therethrough at the rate of 0.1 $nm^3$ per 1 $m^3$ of the emulsion. The contact time is 30 minutes; the separation time is 1 hour.

The emulsion breakdown yields anhydrous kerosene.

EXAMPLE 10

The emulsion is that of gas oil obtained by direct distillation of high-tar oil.

The tar content of the gas oil is 0.4 vol.%; the water content of the emulsion is 20 vol.%.

Said emulsion is heated to a temperature of 65°C, and then air is bubbled therethrough at the rate of 4 $nm^3$ per 1 $m^3$ of the emulsion. The contact time is 1 hour; the separation time is 2 hours.

The emulsion breakdown yields anhydrous gas oil.

What is claimed is:

1. A method of breaking down oil emulsions, which comprises heating the oil emulsion to be broken to a temperature of from 40° to 70°C; bubbling air through said heated oil emulsion at the rate of from 0.1 to 10 $nm^3$ per 1 $m^3$ of the oil emulsion until total breakdown of the emulsion as a result of oxidation of the natural oil emulsifying agents contained therein; settling the mixture to provide for the separation of oil and water; and separating the oil from the water layer.

2. A method as claimed in claim 1, whereby said oil emulsion is heated to a temperature of from 60° to 65°C.

3. A method as claimed in claim 1, whereby air is bubbled through the emulsion at the rate of from 1 to 4 $nm^3$ per 1 $m^3$ of the oil emulsion.

* * * * *